US009748705B2

(12) United States Patent
Ejiri et al.

(10) Patent No.: US 9,748,705 B2
(45) Date of Patent: Aug. 29, 2017

(54) CONTACT STRUCTURE

(71) Applicant: SMK Corporation, Tokyo (JP)

(72) Inventors: Koichiro Ejiri, Kanagawa (JP); Haruhiko Kondo, Kanagawa (JP); Rie Abe, Kanagawa (JP); Hidemasa Sakurada, Ibaraki (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/297,157

(22) Filed: Oct. 19, 2016

(65) Prior Publication Data

US 2017/0194752 A1 Jul. 6, 2017

(30) Foreign Application Priority Data

Oct. 22, 2015 (JP) ..... 2015-207973

(51) Int. Cl.

| | |
|---|---|
| ***H01R 13/53*** | (2006.01) |
| ***H01R 13/66*** | (2006.01) |
| ***H01H 1/38*** | (2006.01) |
| ***H01R 13/11*** | (2006.01) |

(52) U.S. Cl.
CPC ..... *H01R 13/6616* (2013.01); *H01H 1/38* (2013.01); *H01R 13/113* (2013.01)

(58) Field of Classification Search
CPC ..... H01R 13/6616; H01R 13/7124; H01R 13/005; H01R 13/113; H01R 24/46; H01R 13/53; H01R 13/6485; H01R 13/6666; H01R 23/025; H01R 13/03; H01H 1/38
See application file for complete search history.

(56) References Cited

U.S. PATENT DOCUMENTS

| | | | | |
|---|---|---|---|---|
| 7,938,660 | B1 * | 5/2011 | Beak | H01R 13/701 439/269.1 |
| 8,747,134 | B2 * | 6/2014 | Schlogl | H01R 13/005 439/194 |
| 9,281,635 | B2 * | 3/2016 | Beak | H01R 13/7132 |
| 9,385,490 | B2 * | 7/2016 | Ando | H01R 24/46 |
| 9,420,663 | B1 * | 8/2016 | Hsia | H02M 1/32 |
| 2010/0029110 | A1 | 2/2010 | Kiryu et al. | |

FOREIGN PATENT DOCUMENTS

| | | |
|---|---|---|
| JP | S63-86281 A | 4/1988 |
| JP | H4-2467 U | 1/1992 |

* cited by examiner

*Primary Examiner* — Jean F Duverne

(57) ABSTRACT

A contact structure is provided. The contact structure suppresses arcing that can occur between contacts that establish a live connection, without increasing the size of the contact structure, and without making longer the length of the inserting/drawing stroke of a correspondingly formed contact. A live contact portion of a first contact, and an auxiliary contact portion of an auxiliary contact body configured with a high resistance resistor having a base end connected portion that establishes an electrical connection with the first contact front on a movement path of a second contact at positions that are shifted in front and rear directions while being distanced by a width that allows simultaneously contact with the second contact. If the second contact separates from the first contact, the auxiliary contact body configured with the high resistance resistor intervenes between the first contact and the second contact, and inhibits arcing.

6 Claims, 8 Drawing Sheets

CONTACT STRUCTURE

The contents of the following Japanese patent application are incorporated herein by reference:

No. 2015-207973 filed on Oct. 22, 2015.

BACKGROUND

1. Technical Field

The present invention relates to a contact structure between a pair of contacts that respectively establish live connections with electrical circuits, and more specifically, relates to a contact structure for a pair of contacts that contact and separate from each other and between which a high electrical energy occurs.

2. Related Art

An electrical connector that establishes a live connection for an electric power line that transmits high voltage, high current electric power or the like accumulates a high electrical energy between a pair of adjoining contacts when a correspondingly formed connector connected is inserted and drawn out, and arcing occurs therebetween. Such arcing occurs also due to an induced electromotive force generated when one connector connected to an inductive load is drawn out of another connector connected to an electric power line.

Conventionally, there have been measures taken against arcing because it becomes a cause of accelerated degradation of a contact of an electrical connector due to erosion of it or the like, and such measures are generally classified into two methods. In a first method, which is exemplified by a method disclosed in Japanese Patent Application Publication No. 2010-56055 (Patent Document 1), a permanent magnet or the like is arranged in a direction orthogonal to a direction in which a pair of contacts face each other to apply a magnetic field, and the direction of arcing is deflected by a Lorentz force to prevent damages to the contact due to arcing.

Also, a second method is a method by which arcing is prevented from occurring by lowering an electrical energy itself accumulated between a pair of contacts. Because the electrical energy accumulated between a pair of contacts is proportional to the voltage and current between the pair of contacts, in Japanese Patent Application Publication No. S63-86281 (Patent Document 2) and Japanese Utility Model Application Publication No. H4-2467 (Patent Document 3), occurrence of arcing is prevented by lowering the voltage between a pair of contacts when the contacts separate.

That is, in a contact structure 100 described in Patent Document 2, as shown in FIG. 8, a contact 101 and a resistor 102 having an electrical resistivity ρ higher than that of the contact 101 are provided continuously along a movement path along which a contact 103 of a correspondingly formed connector moves, and when the other contact 103 is drawn out of and separate from the movement path, the contact 103 is separated at a leading edge 102*a* of the resistor 102 having the highest resistance value, thereby making the voltage between them a voltage that does not cause arcing, so as to prevent occurrence of arcing.

Also, in a contact structure 110 described in Patent Document 3, as shown in FIGS. 9A and 9B, the resistance value of a contact 112 is made higher at positions farther in the separation direction (rightward in the figure) along a movement path along which a correspondingly formed contact 114 moves. When the correspondingly formed contact 114 initially inserted completely as shown in FIG. 9A is drawn out of the movement path as shown in FIG. 9B, a significant potential drop is caused to the contact 112 by making the highest the resistance of the portion of a leading edge 112*a* of the contact 112 which the contact 114 adjoins, thereby making the voltage between the leading edge 112*a* and the contact 114 a voltage that does not cause arcing.

PRIOR ART DOCUMENTS

Patent Document

[Patent Document 1] Japanese Patent Application Publication No. 2010-56055

[Patent Document 2] Japanese Patent Application Publication No. S63-86281

[Patent Document 3] Japanese Utility Model Application Publication No. H4-2467

Because in the first method shown in Patent Document 1, a permanent magnet or the like is arranged in a direction orthogonal to a direction in which a pair of contacts face each other to generate a magnetic field, the structure is complicated, and the size of the contact structure increases. Additionally, because it does not prevent occurrence of arcing itself, electromagnetic noise caused by arcing affects an electronic circuit such as a load. Therefore, it is not a fundamental solution.

Also, because in the conventional contact structures 100, 110 according to the second method described in Patent Document 2 and Patent Document 3, occurrence of arcing is prevented by lowering the voltages relative to the contacts 103, 114 at positions at which the contacts 103, 114 separate. Accordingly, it has been necessary to connect the high resistance resistor 102 to a leading edge side of the contact 101 or to form a conductor having resistance that gradually increases from the contact 112 toward the leading edge 112*a* side. For this reason, extra resistors are connected to leading edge sides of the contacts 101, 112 connected to the contacts 103, 114 at low contact resistance, and so the sizes of the entire structures increase, and strokes of the contacts 103, 114 in the insertion/drawing directions become longer.

In particular, because in the contact structure 100 in which the resistor 102 is formed from the conductive material having the high electrical resistivity ρ, the resistance value up to the leading edge 102*a* of the resistor 102 is proportional to the distance from the position at which it connects with the contact 101, attaining, at the leading edge 102*a*, a resistance value that attains a voltage lowered to suppress arcing requires making the length of the resistor 102 sufficiently long.

In view of this, the present applicant has applied for a patent of a contact structure 120 in which the length of a resistor 121 from a contact 123 in an X-direction is made short by adopting, as the shape of the resistor 121, a conical shape having a cross-sectional area that decreases in the X-direction toward the leading edge side as shown in FIG. 10 (Japanese Patent Application No. 2015-126327). However, a drawback about the size of the contact structure 120 increasing because the resistor 121 is connected on the leading edge side of the contact 123 is not fundamentally solved, and if the resistor 121 is formed from a conductive material such as ferrite having a high electrical resistivity ρ, a contact surface of a correspondingly formed contact 122 that slide-contacts the resistor 102 wears off, and wear debris intervene between the contact 122 and the contact 123 to increase contact resistance.

The present invention has been made in view of the above drawbacks accompanying the related art, and it is an object of the present invention to provide a contact structure that suppresses arcing, without increasing the size of the contact structure, and without making longer the length of the inserting/drawing stroke of a correspondingly formed contact.

Also, it is also an object of the present invention to provide a contact structure that can establish an electrical connection between contacts at low contact resistance even if an auxiliary contact body is formed from a hard conductive material in order to suppress arcing.

SUMMARY

In order to achieve the above-mentioned objects, in a contact structure according to a first aspect of the present invention, a live contact portion and an auxiliary contact portion of an auxiliary contact body in a first contact front on a movement path of a second contact at positions shifted in front and rear directions while being distanced by a width that allows the live contact portion and the auxiliary contact portion to simultaneously contact the second contact, the second contact contacting and separating from the first contact along with advancing/withdrawing movements in front and rear directions, if moved forward, the second contact contacts the auxiliary contact portion, and then contacts the live contact portion to establish a live connection with the first contact, and if moved backward, the second contact separates from the live contact portion, and then separates from the auxiliary contact portion, the auxiliary contact body is always in an electrical connection with the first contact at a base end connected portion before the live contact portion, and the auxiliary contact body is formed from a high resistance resistor having a resistance value between the auxiliary contact portion and the base end connected portion such that the resistance value suppresses arcing between the second contact and the auxiliary contact portion.

Because the second contact, while being in contact with the live contact portion of the first contact, contacts also the auxiliary contact portion of the auxiliary contact body, and the auxiliary contact body between the auxiliary contact portion and the base end connected portion is connected in parallel with the first contact, even if the resistance value therebetween is sufficiently high to the extent that suppresses arcing between the second contact and the auxiliary contact portion, a live connection is established between the first contact and the second contact at low contact resistance. On the other hand, even if instantaneous interruption occurs between the second contact and the live contact portion of the first contact, because the auxiliary contact body having a high resistance value is connected in parallel, arcing does not occur between the second contact and the first contact between which the instantaneous interruption has occurred.

Because when the second contact separates from the first contact, the second contact contacts only the auxiliary contact portion of the auxiliary contact body, and the resistance value between the auxiliary contact portion and the base end connected portion is a resistance value that suppresses arcing between the second contact and the auxiliary contact portion, arcing is suppressed.

In a contact structure according to a second aspect of the present invention, the auxiliary contact body is formed from a conductive material having a high electrical resistivity relative to the first contact, the live contact portion and the auxiliary contact portion are caused to front on the movement path at positions that are shifted forward and backward such that a first contact movement trajectory of the live contact portion and a second contact movement trajectory of the auxiliary contact portion that move relative to the second contact in front and rear directions do not overlap each other.

Because the auxiliary contact body is formed from a conductive material having a high electrical resistivity relative to the first contact, the resistance value between the auxiliary contact portion and the base end connected portion can be easily made higher than the resistance value of the first contact connected in parallel, and arcing generating energy accumulated between the first contact and the second contact at the instant when the second contact separates from the first contact can be reduced.

Because even if the auxiliary contact body is formed from a conductive material having a high electrical resistivity relative to the first contact, and the region of the second contact movement trajectory of the second contact is worn off, the first contact slide-contacts the first contact movement trajectory of the second contact that does not overlap the second contact movement trajectory, an electrical connection is established between the first contact and the second contact at low contact resistance.

In a contact structure according to a third aspect of the present invention, the live contact portion and the auxiliary contact portion are configured to be able to contact mutually different surfaces among front and rear surfaces of the second contact.

Because the live connection portion and the auxiliary contact portion of the auxiliary contact body in the first contact contact mutually different surfaces among front and rear surfaces of the second contact, even if the auxiliary contact body is formed from a hard conductive material, and the slide-contact surface of the second contact is worn off, the contact between the first contact and the second contact that contact at the different surfaces is not affected.

A contact structure according to a fourth aspect of the present invention includes:

the first contact that has:

a tubular body that is formed into a tubular shape surrounding an axis extending in front and rear directions, and in which the movement path of the second contact lies continuously; and a contact piece portion that is provided continuously on a bottom surface of the tubular body, and has a free end side at which the live contact portion fronts on the movement path in the tubular body;

the auxiliary contact body that is arranged in front and rear directions along a planar surface of the tubular body, and has the auxiliary contact portion that fronts on the movement path at a rear portion of the tubular body; and a clip that has:

a fixed connected portion that clips a base end connected portion of a front end of the auxiliary contact body and a planar surface portion of the tubular body; and a spring piece portion that is arranged along the auxiliary contact body, and urges the auxiliary contact body in a direction of the movement path about the fixed connected portion, wherein the auxiliary contact portion is configured to elastically contact a front surface of the second contact, and the live contact portion is configured to elastically contact a rear surface of the second contact before a position at which the auxiliary contact portion contacts the front surface of the second contact.

The base end connected portion at the front end of the auxiliary contact body is clipped by the fixed connected portion of the clip together with the planar surface portion of the first contact, and is always in an electrical connection with the first contact at the base end connected portion before the auxiliary contact portion.

Because while the auxiliary contact portion urged in a direction of the movement path by the spring piece portion of the clip is elastically contacting the second contact, the auxiliary contact body separates from the first contact except for the auxiliary contact portion that contacts the second contact and the base end connected portion that is always in an electrical connection with the first contact, a high resistance value between the auxiliary contact portion and the base end connected portion intervenes between the first contact and the auxiliary contact portion.

In a contact structure according to a fifth aspect of the present invention, the live contact portion and the auxiliary contact portion are configured to be able to contact at positions which are on a single front or rear surface of the second contact and are shifted in left and right directions that are orthogonal to front and rear directions.

Because the live connection portion and the auxiliary contact portion of the auxiliary contact body in the first contact contact at positions of the second contact that are shifted in left and right directions, even if the auxiliary contact body is formed from a hard conductive material, and the slide-contact surface of the second contact is worn off, the contact between the first contact and the second contact is not affected.

In a contact structure according to a sixth aspect of the present invention, the auxiliary contact body is formed from ferrite, and the first contact movement trajectory of the second contact is plated.

Because ferrite is a conductive material having a high electrical resistivity, even if the length between the auxiliary contact portion and the base end connected portion is made short, the resistance value therebetween can be made sufficiently high to suppress arcing between the second contact and the auxiliary contact portion.

Because the first contact slide-contacts the region of the plated first contact movement trajectory of the second contact, the first contact establishes a live connection with the second contact highly reliably.

According to the first aspect of the present invention, because a main portion of the auxiliary contact body that suppresses arcing can be arranged in parallel with the first contact, the size of the contact structure does not increase in the advancing/withdrawing movement directions of the second contact, and the movement stroke for the second contact to contact and separate from the first contact does not increase.

Also, because it is not necessary to connect the auxiliary contact body to the first contact along the advancing/withdrawing movement directions of the second contact, a resistor having any size or shape with a resistance value between the auxiliary contact portion and the base end connected portion sufficiently high to suppress arcing between the second contact and the auxiliary contact portion can be used as the auxiliary contact body.

According to the second aspect of the present invention, because the auxiliary contact body formed from a conductive material having a high electrical resistivity $\rho$ can be arranged in parallel with the first contact along the movement path of the second contact, the resistance value between the auxiliary contact portion and the base end connected portion can be made high easily without making longer the length in a direction along the movement path.

Also, even if the auxiliary contact body formed from the conductive material having the high electrical resistivity wears off a slide-contact surface of the second contact, the contact between the first contact and the second contact is not affected, and the first contact and the second contact electrically connect with each other at low contact resistance.

According to the third aspect and fifth aspect of the present invention, even if the auxiliary contact body is formed from the hard conductive material having the high electrical resistivity, the contact between the first contact and the second contact is not affected, and the first contact and the second contact establish an electrical connection with each other at low contact resistance.

According to the fourth aspect of the present invention, with a simple configuration in which the base end connected portion of the auxiliary contact body and the planar surface portion of the first contact are clipped by the fixed connected portion of the clip, and the auxiliary contact portion is urged in a direction of the movement path by the spring piece portion, the auxiliary contact body that elastically contacts the second contact, and connects to the second contact in parallel with the first contact can be configured.

According to the sixth aspect of the present invention, because the auxiliary contact body formed from ferrite never slides along the first contact movement trajectory, the plating covering the first contact movement trajectory along which the live contact portion of the first contact slide-contacts is never destroyed by sliding of the ferrite.

DESCRIPTION OF EXEMPLARY EMBODIMENTS

Figure 1:
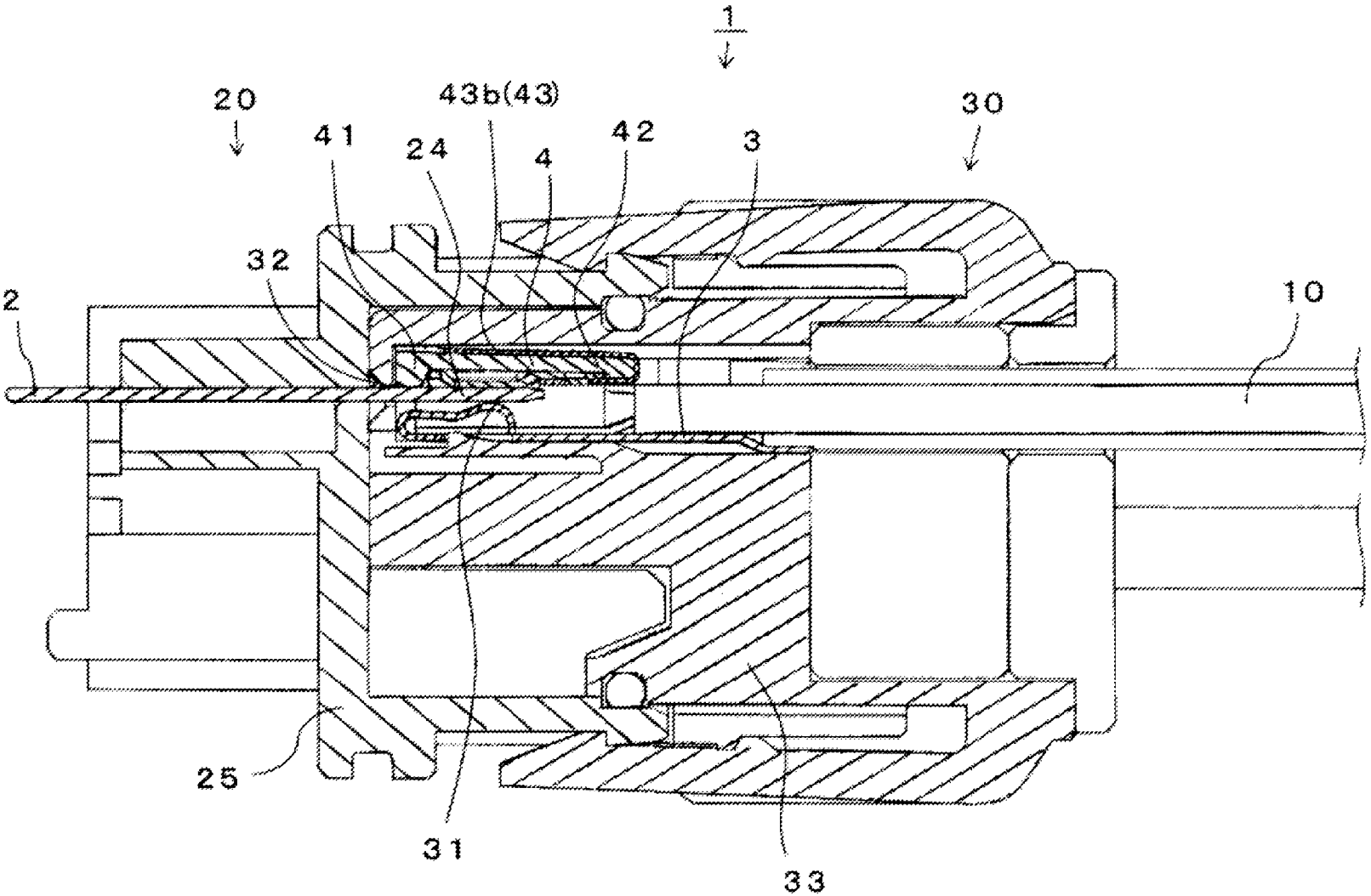
FIG. 1 is a vertical cross-sectional view showing a state where a plug 20 having a male contact 2 and a socket 30 having a female contact 3 in a contact structure 1 according to one embodiment of the present invention are connected with each other.

Hereinafter, a contact structure 1 according to one embodiment of the present invention is explained with reference to FIG. 1 to FIG. 6. The contact structure 1 is a structure in which a male contact 2 which is a second contact contacts and separates from a female contact 3 which is a first contact. In the present specification, each portion is explained in reference to: a front direction which is a connection direction in which the male contact 2 is moved toward the female contact 3; a rear direction which is a separation direction in which the male contact 2 is moved to separate from a contact position at which it contacts the female contact 3; up and down directions which are the up and down directions illustrated in FIG. 1; and left and right directions which are directions orthogonal to the surface of the sheet of paper on which FIG. 1 is illustrated.

The male contact 2 is provided to a plug 20 to be a male connector to connect to a terminal of a DC power source electric power line, and the female contact 3 is provided to a socket 30 to be a female connector to connect to a load that operates by receiving an electric power supply from a DC power source electric power line 10. By inserting the male contact 2 of the plug 20 into a plug insertion hole 32 of the socket 30 to establish a live connection between the male contact 2 and the female contact 3 that fronts on the plug insertion hole 32, an electric power of 96 W (48 V, 2 A), for example, is supplied from the DC power source electric power line 10 to the load.

Figure 2:
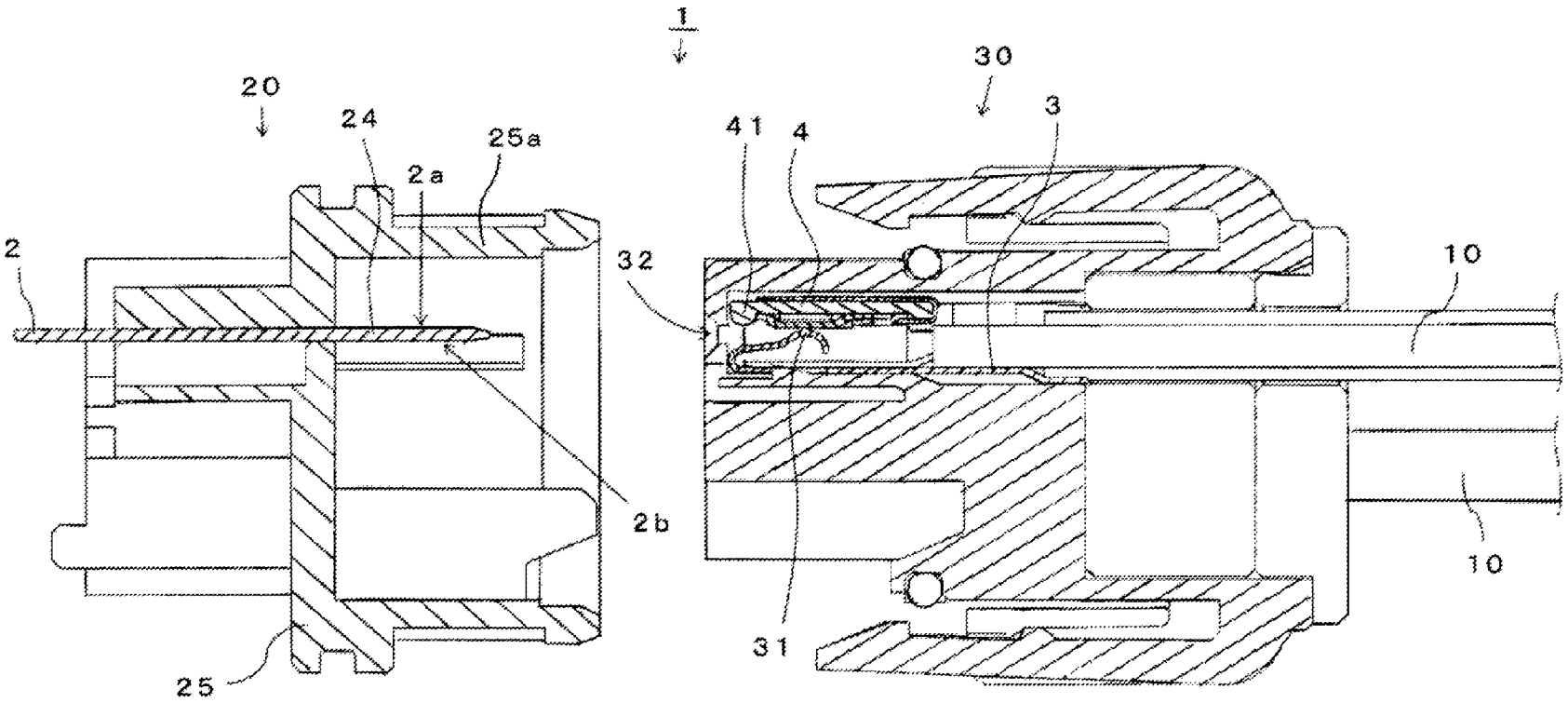
FIG. 2 is a vertical cross-sectional view of the plug 20 having the male contact 2 and the socket 30 having the female contact 3 before they are connected with each other.

Although three male contacts 2 and three female contacts 3 are arranged at prescribed locations at intervals of 60 degrees about an axis that extends in the front and rear directions in the plug 20 and the socket 30, respectively, the contact structure 1 of a pair of the male contact 2 and the female contact 3 that appear on a vertical cross-section shown in FIG. 1 and FIG. 2 is explained in the present specification. As shown in these figures, the male contact 2 formed into a flat-blade knife shape having its thickness direction in the up and down directions by pressing of a copper alloy metallic plate made of phosphor bronze, brass, etc., is attached to an insulating case 25 of the plug 20 to penetrate the insulating case 25 in the rear and front directions.

A rear end portion of the male contact 2 that protrudes backward from the insulating case 25 connects to a DC power source electric power line (not illustrated in the figures), and also a front end portion of the male contact 2 that protrudes forward within a concave engaging portion 25*a* of the insulating case 25 is inserted into the plug insertion hole 32 of the socket 30, thereby forming a plug contact portion 24 in which an auxiliary contact portion 41 of an auxiliary contact body 4 (described below) and a live contact portion 31 (described below) of the female contact 3 slide-contact a planar surface 2*a* and a bottom surface 2*b*, respectively. Among them, the bottom surface 2*b* of the plug contact portion 24 which the live contact portion 31 of the female contact 3 slide-contacts is entirely gilded so that it contacts the live contact portion 31 with high contact reliability.

The length of the plug contact portion 24 in the front and rear directions is at least longer than the interval between the auxiliary contact portion 41 and the live contact portion 31 in the front and rear directions; thereby, while the male contact 2 is contacting the female contact 3, it also always contacts the auxiliary contact portion 41 of the auxiliary contact body 4.

Figure 6:
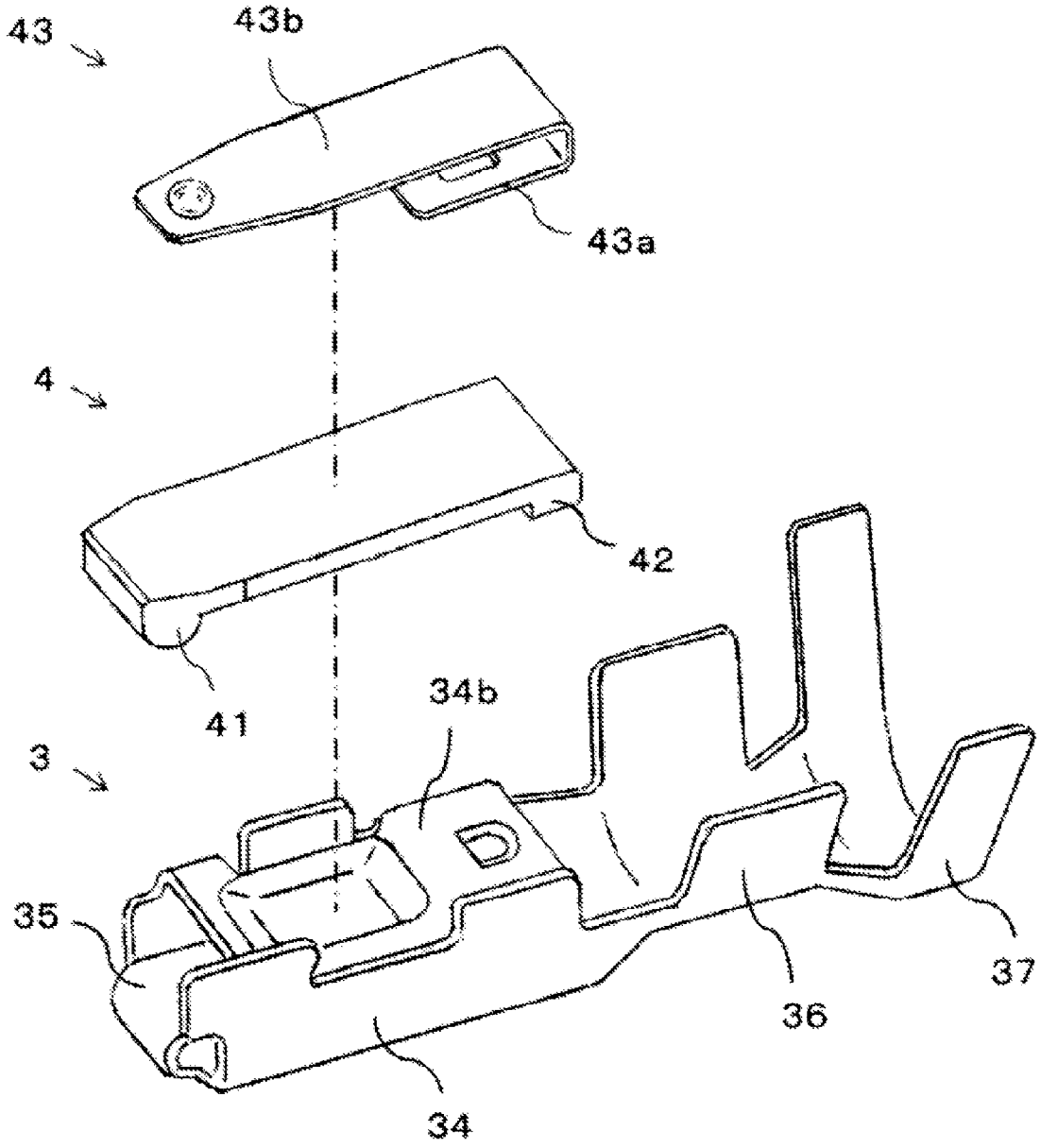
FIG. 6 is an exploded perspective view of FIG. 5.

The female contact 3 formed by pressing of a copper alloy metallic plate made of phosphor bronze, brass, etc. is attached to an insulating case 33 of the socket 30 along the front and rear directions as shown in FIG. 1 and FIG. 2. The female contact 3 is arranged within the insulating case 33 before the plug insertion hole 32 along a movement path of the plug contact portion 24 to be inserted into and drawn out of the socket 30, and a rear portion thereof forms a tubular body 34 formed into a square tubular shape as shown in FIG. 6 by which the plug contact portion 24 inserted into the plug insertion hole 32 is guided in the front and rear directions along the movement path within the tubular body 34. At a front portion of the tubular body 34, a core wire-clamp barrel 36 and a covering-clamp barrel 37 which respectively have shapes obtained by opening cylindrical tubes into U-shapes are formed integrally. The core wire-clamp barrel 36 is swaged with a core wire of the DC power source electric power line 10 therein to electrically connect the female contact 3 and the DC power line 10. The covering-clamp barrel 37 clamps a covering around the DC power source electric power line 10 to mechanically fasten the female contact 3 and the DC power line 10.

Figure 3:
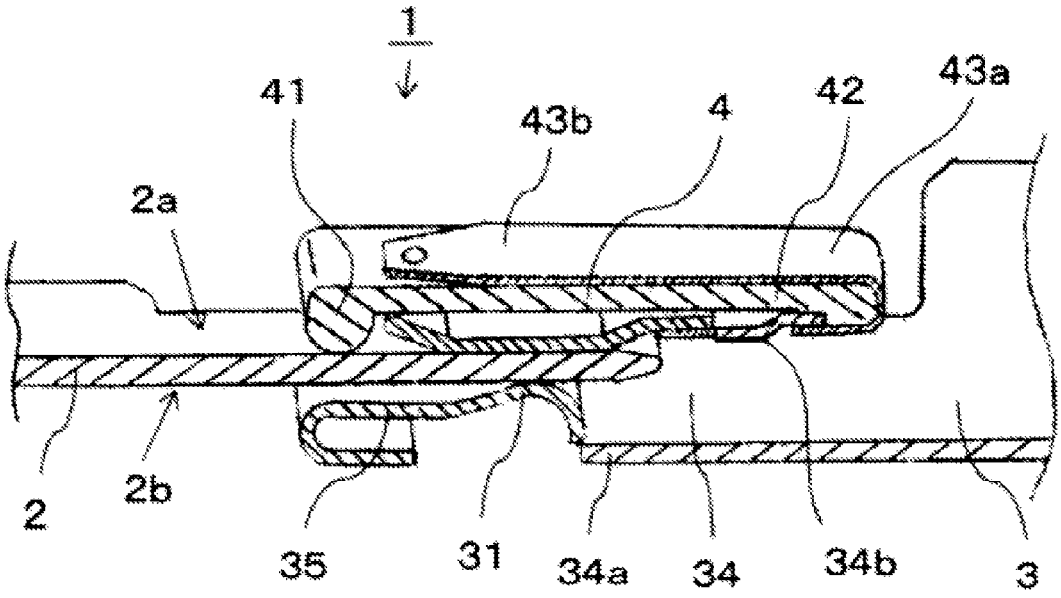
FIG. 3 is a perspective view of main portions in the contact structure 1.

A contact piece portion 35 configured with a spring piece formed by being folded into a U-shape which opens forward toward the inside of the tubular body 34 is provided continuously at the front end of a bottom surface portion 34*a* of the tubular body 34, and as shown in FIG. 3, an upper end portion of the free end side of the contact piece portion 35 forms the live contact portion 31 that gently curves upward. The live contact portion 31 is urged upward by the contact piece portion 35 which is cantilever-supported at the front end of the bottom surface portion 34*a*. The live contact portion 31 abuts on an inner surface of a planar surface portion 34*b* within the tubular body 34 in a stand-by state in which a plug is not connected. The live contact portion 31 elastically contacts a rear surface 2*b* of the plug contact portion 24 when the plug contact portion 24 is inserted into the tubular body 34.

Figure 5:
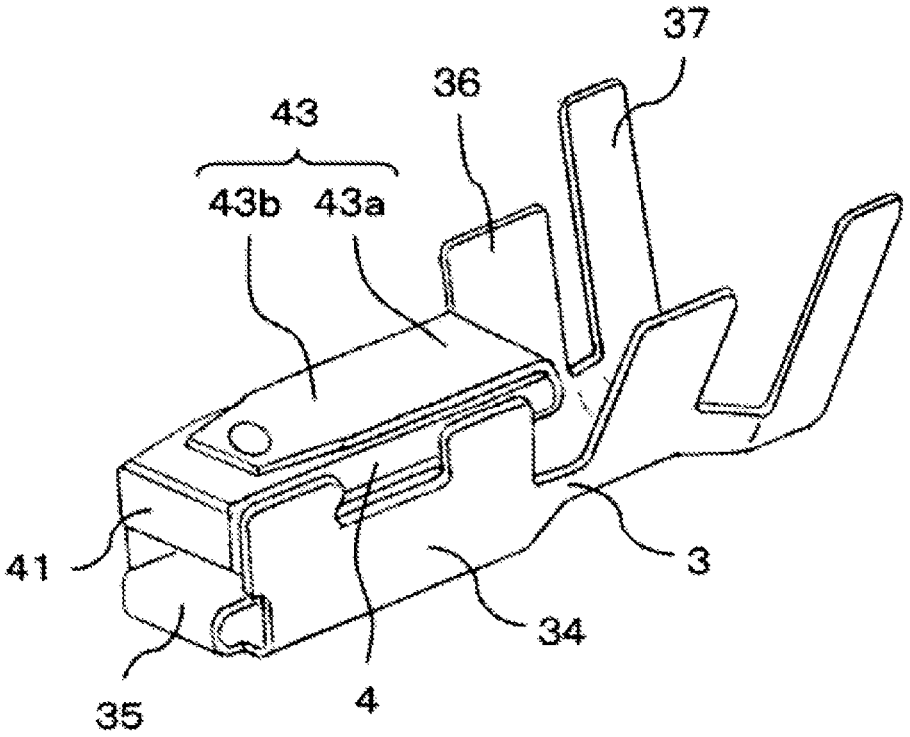
FIG. 5 is a perspective view showing the female contact 3 side.

As shown in FIG. 5 and FIG. 6, the auxiliary contact body 4 for inhibiting arcing between the male contact 2 and the female contact 3 is arranged along the upper surface of the tubular body 34 (planar surface portion 34*b*). The auxiliary contact body 4 is formed from ferrite having a significantly higher electrical resistivity than the conductive material of the female contact 3 and into a flat plate shape having its longitudinal direction in the front and rear directions. The rear end of the auxiliary contact body 4 forms the auxiliary contact portion 41 bulged downward, and its front end forms a base end connected portion 42 to be arranged on the planar surface portion 34*b* at the front end of the tubular body 34.

By swaging a fixed connected portion 43*a* of a clip 43 configured with a belt-like metallic piece, the base end connected portion 42 is clipped together with the front end of the planar surface portion 34*b* of the tubular body 34. The base end connected portion 42 at the front end of the auxiliary contact body 4 is thereby fixed to the female contact 3, and always electrically connects with the female contact 3.

A spring piece portion 43*b* behind the fixed connected portion 43*a* of the clip 43 abuts on the upper surface of the auxiliary contact body 4, and urges, counterclockwise in FIG. 1, the auxiliary contact body 4 with the base end connected portion 42 as the center of the urging. In a stand-by state in which the plug 20 is not inserted, the spring piece portion 43*b* causes the auxiliary contact portion 41 to front on, behind the live contact portion 31, the movement path of the plug contact portion 24.

When the male contact 2 of the thus-configured plug 20 is inserted forward toward the plug insertion hole 32 of the socket 30, initially, the auxiliary contact portion 41 of the auxiliary contact body 4 slide-contacts a front surface 2*a* of the plug contact portion 24 of the male contact 2. At this time, the auxiliary contact portion 41 is raised upward by the plug contact portion 24, and the auxiliary contact body 4 revolves clockwise in FIG. 1 with the base end connected portion 42 as the center of the revolving, and separates from the female contact 3 except for the base end connected portion 42. As a result, a high resistance value $R_2$ of the auxiliary contact body 4 proportional to the length from the base end connected portion 42 to the auxiliary contact portion 41 is connected in series between the DC power source electric power line 10 and the male contact 2. Because the auxiliary contact body 4 is formed from ferrite having a high electrical resistivity, the voltage between the auxiliary contact portion 41 and the male contact 2 significantly lowers due to the high resistance value $R_2$ being connected in series, and energy is not accumulated therebetween to the extent that causes arcing.

Figure 4:
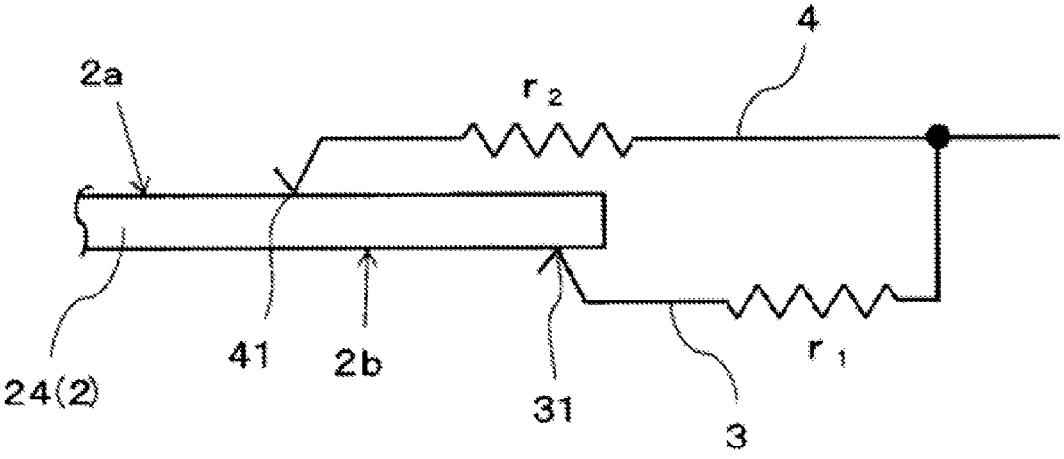
FIG. 4 is a circuit diagram of FIG. 3.

Because the live contact portion 31 of the female contact 3 fronts on a front portion of the auxiliary contact portion 41 along the movement path of the plug contact portion 24, when the plug contact portion 24 is inserted further forward, the live contact portion 31 elastically contacts the rear surface 2*b* of the plug contact portion 24, and along with the movement of the plug contact portion 24, slide-contacts the rear surface 2*b*. As a result, the female contact 3 and the male contact 2 that connect to the DC power source electric power line 10 establish a live connection to each other via a minute resistance value $R_1$ of the female contact 3. As shown in FIG. 4, because while contacting the live contact portion 31, the plug contact portion 24 also contacts the auxiliary contact portion 41, the high resistance value $R_2$ of the auxiliary contact body 4 and the resistance value $R_1$ of the female contact 3 are connected in parallel between the female contact 3 and the male contact 2. But because the resistance value $R_2$ of the auxiliary contact body 4 is negligible because it is so high relative to the resistance value $R_1$ that the connection between the female contact 3 and the male contact 2 is not affected. On the other hand, even if instantaneous interruption occurs between the rear surface 2*b* of the plug contact portion 24 and the live contact portion 31 due to vibration of the socket 30 or the like, arcing does not occur between the plug contact portion 24 and the live contact portion 31 because the auxiliary contact body 4 is connected between the female contact 3 and the male contact 2.

Also when the plug contact portion 24 is moved backward from a position at which it is connected with the live contact portion 31 to separate from the live contact portion 31, energy to generate arcing between the plug contact portion 24 and the female contact 3 is unlikely to be accumulated because the high resistance value $R_2$ of the auxiliary contact body 4 intervenes therebetween. Also when the plug contact portion 24 is moved further backward to separate from the auxiliary contact portion 41, the voltage between the auxiliary contact portion 41 and the plug contact portion 24 of the male contact 2 lowers significantly due to the high resistance value $R_2$ being connected in series, and energy is not accumulated to the extent that causes arcing therebetween.

In the present embodiment, because the auxiliary contact body 4 formed from ferrite having a high electrical resistivity is arranged along the longitudinal direction of the tubular body 34 which is parallel with the movement path of the plug contact portion 24, the length from the base end connected portion 42 to the auxiliary contact portion 41 in the auxiliary contact body 4 can be made almost equal to the length of the tubular body 34, and the resistance value $R_2$ of the auxiliary contact body 4 can be made sufficiently high to inhibit arcing without increasing the size of the socket 30.

Also, because even if the auxiliary contact portion 41 formed from hard ferrite slide-contacts the front surface 2*a* of the plug contact portion 24 to wear off the front surface 2*a*, the live contact portion 31 slide-contacts the plated rear surface 2*b* of the plug contact portion 24, the female contact 3 and the male contact 2 are connected with high contact reliability, and are connected at low contact resistance without the plating formed on the contact surface between the live contact portion 31 and the plug contact portion 24 being roughened by the auxiliary contact portion 41.

In this manner, in the above-mentioned embodiment, the front and rear surfaces 2*a*, 2*b* of the male contact 2 are allotted as surfaces on which the live contact portion 31 and the auxiliary contact portion 41 contact the plug contact portion 24 so that the respective sliding trajectories on the plug contact portion 24 do not overlap, but the live contact portion 31 and the auxiliary contact portion 41 may be caused to contact a single surface of the male contact 2.

Figure 7:
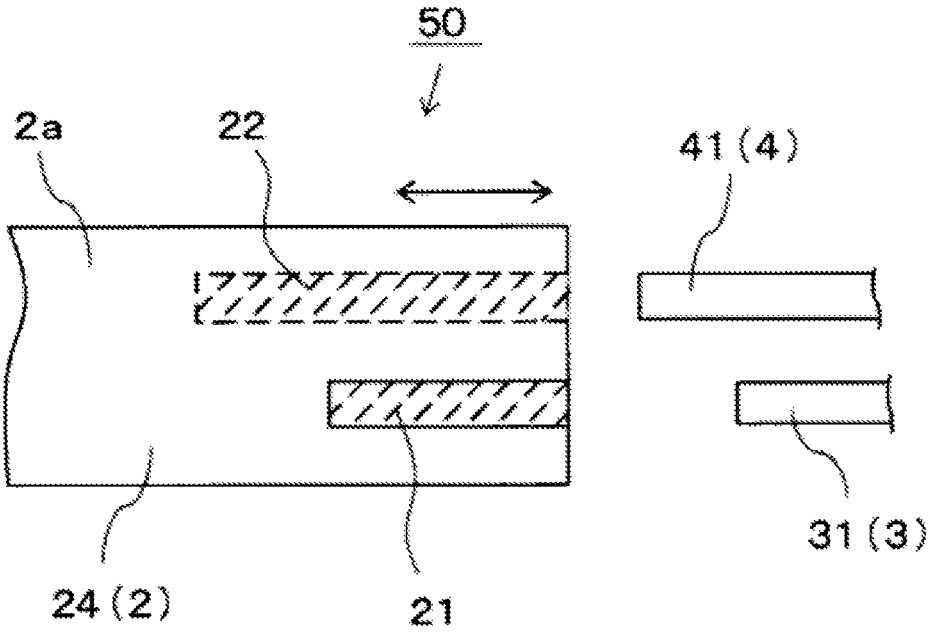
FIG. 7 is a plan showing a contact movement trajectory 21 of a live contact portion 31 and a contact movement trajectory 22 of an auxiliary contact portion 41 that slide-contact a front surface 2*a* of the male contact 2 according to another embodiment.
Figure 8:
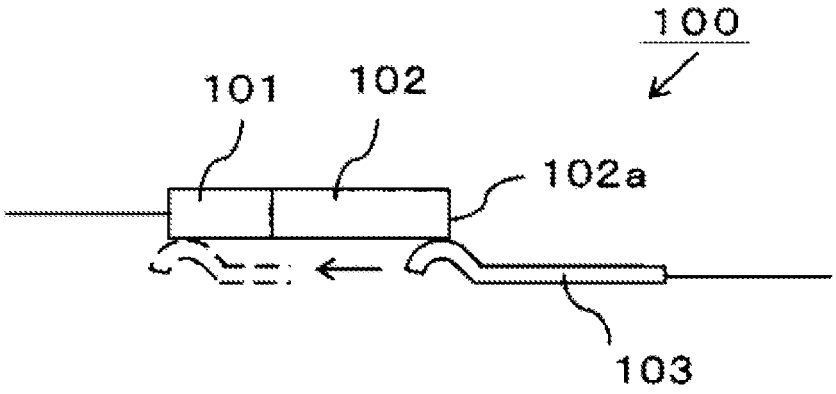
(RELATED ART) FIG. 8
FIG. 8 is a side view of a related contact structure 100.
Figure 9A:
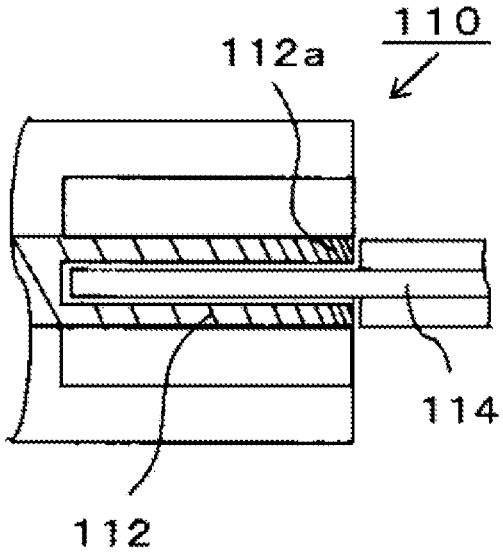
(RELATED ART) FIG. 9A
FIG. 9A is a vertical cross-sectional view showing a state where a contact 114 formed corresponding to a related contact structure 110 is inserted completely.
Figure 9B:
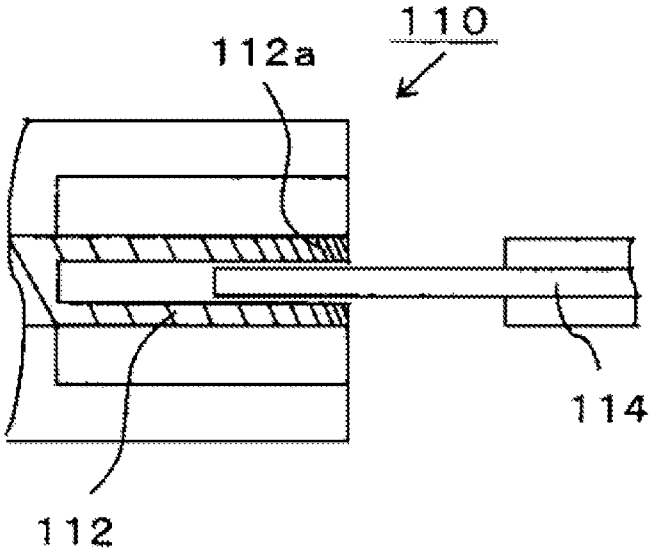
(RELATED ART) FIG. 9B
FIG. 9B is a vertical cross-sectional view showing a state where the contact 114 formed corresponding to the related contact structure 110 is drawn out of a movement path.
Figure 10:
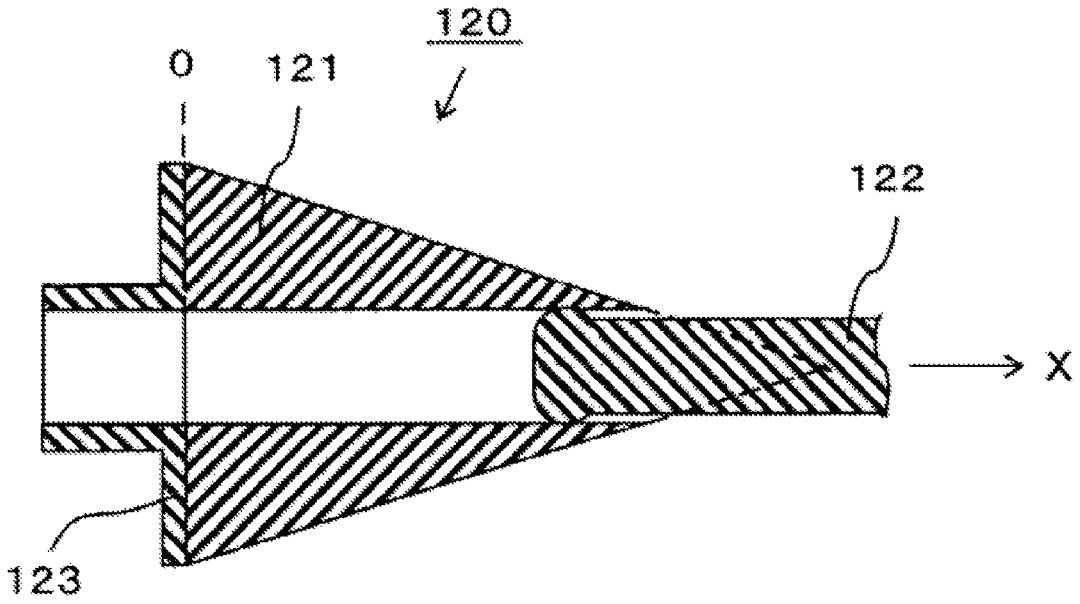
(RELATED ART) FIG. 10
FIG. 10 is a vertical cross-sectional view showing another contact structure 120.

FIG. 7 shows a contact structure 50 according to another embodiment in which the live contact portion 31 and the auxiliary contact portion 41 slide-contact a single surface of the male contact 2. The configurations of respective portions illustrated perform their functions in the same or similar manners as their counterparts in the first embodiment, and so the portions are denoted with the same numbers. In this embodiment, the live contact portion 31 and the auxiliary contact portion 41 front the movement path of the plug contact portion 24 from above at positions of the insulating case 33 that are shifted in the left and right directions. Accordingly, as illustrated in the figure, along with relative movement of the plug contact portion 24 in the front and rear directions, the live contact portion 31 and the auxiliary contact portion 41 respectively slide-contact a first slide movement trajectory 21 and a second slide movement trajectory 22 on the front surface 2*a* of the plug contact portion 24 that are shifted in the left and right directions. As a result, even if the auxiliary contact portion 41 is formed from a hard material that can damage a contact surface, the contact between the live contact portion 31 and the plug contact portion 24 is not affected. Also in the present embodiment, the first slide movement trajectory along which the live contact portion 31 and the plug contact portion 24 slide-contact may be covered with partial plating such as gilding.

If the auxiliary contact portion 41 of the auxiliary contact body 4 is not formed from a material that can roughen a contact surface like the live contact portion 31, the first slide movement trajectory 21 and the second slide movement trajectory 22 may partially or entirely front on overlapping movement paths.

Although in the above-mentioned embodiment, the auxiliary contact body 4 is formed from ferrite having a high electrical resistivity, any high resistance resistor may be used as long as it provides a resistance value between the base end connected portion 42 and the auxiliary contact portion 41 that can lower a potential of the auxiliary contact portion 41 to the extent that inhibits arcing.

Also, although the base end connected portion 42 connects directly to the female contact 3, it may connect to a DC power supply line that always connects to the female contact 3 or connect to another conductor intervening therebetween.

Also, although the above-mentioned embodiments are explained about a contact structure of the male contact 2 of the plug 20 and the female contact 3 of the socket 30 that establishes a live connection for DC power, a set of contacts for a live connection can be applied to a contact structure used for a relay or a switch, other than an electrical connector configured with a plug and a socket.

INDUSTRIAL APPLICABILITY

Embodiments of the present invention are suited for a contact structure that establishes a live connection between contacts that may generate arcing.

EXPLANATION OF REFERENCE NUMERALS

1: contact structure
2: male contact (second contact)
3: female contact (first contact)
31: live contact portion
4: auxiliary contact body
41: auxiliary contact portion
42: base end connected portion
43: clip
23: plating

What is claimed is:

1. A contact structure, wherein a live contact portion and an auxiliary contact portion of an auxiliary contact body in a first contact front on a movement path of a second contact at positions shifted in front and rear directions while being distanced by a width that allows the live contact portion and the auxiliary contact portion to simultaneously contact the second contact, the second contact contacting and separating from the first contact along with advancing/withdrawing movements in front and rear directions, if moved forward, the second contact contacts the auxiliary contact portion, and then contacts the live contact portion to establish a live connection with the first contact, and if moved backward, the second contact separates from the live contact portion, and then separates from the auxiliary contact portion, the auxiliary contact body is always in an electrical connection with the first contact at a base end connected portion before the live contact portion, and the auxiliary contact body is formed from a high resistance resistor having a resistance value between the auxiliary contact portion and the base end connected portion such that the resistance value suppresses arcing between the second contact and the auxiliary contact portion.

2. The contact structure according to claim 1, wherein the auxiliary contact body is formed from a conductive material having a high electrical resistivity relative to the first contact, the live contact portion and the auxiliary contact portion are caused to front on the movement path at positions that are shifted forward and backward such that a first contact movement trajectory of the live contact portion and a second contact movement trajectory of the auxiliary contact portion that move relative to the second contact in front and rear directions do not overlap each other.

3. The contact structure according to claim 2, wherein the live contact portion and the auxiliary contact portion are configured to be able to contact mutually different surfaces among front and rear surfaces of the second contact.

4. The contact structure according to claim 3, comprising:

the first contact that has:

a tubular body that is formed into a tubular shape surrounding an axis extending in front and rear directions, and in which the movement path of the second contact lies continuously; and a contact piece portion that is provided continuously on a bottom surface of the tubular body, and has a free end side at which the live contact portion fronts on the movement path in the tubular body;

the auxiliary contact body that is arranged in front and rear directions along a planar surface of the tubular body, and has the auxiliary contact portion that fronts on the movement path at a rear portion of the tubular body; and a clip that has:

a fixed connected portion that clips a base end connected portion of a front end of the auxiliary contact body and a planar surface portion of the tubular body; and a spring piece portion that is arranged along the auxiliary contact body, and urges the auxiliary contact body in a direction of the movement path about the fixed connected portion, wherein the auxiliary contact portion is configured to elastically contact a front surface of the second contact, and the live contact portion is configured to elastically contact a rear surface of the second contact before a position at which the auxiliary contact portion contacts the front surface of the second contact.

5. The contact structure according to claim 2, wherein the live contact portion and the auxiliary contact portion are configured to be able to contact at positions which are on a single front or rear surface of the second contact and are shifted in left and right directions that are orthogonal to front and rear directions.

6. The contact structure according to claim 2, wherein the auxiliary contact body is formed from ferrite, and the first contact movement trajectory of the second contact is plated.

* * * * *